US005967453A

United States Patent [19]

Ludwig

[11] Patent Number: 5,967,453

[45] Date of Patent: Oct. 19, 1999

[54] BOBBIN CHUCK

[75] Inventor: Adrian Ludwig, Winterthur, Switzerland

[73] Assignee: Maschinenfabrik Rieter AG, Winterthur, Switzerland

[21] Appl. No.: 09/024,235

[22] Filed: Feb. 17, 1998

[30] Foreign Application Priority Data

Feb. 18, 1997 [CH] Switzerland ..... 0365/97

[51] Int. Cl.[6] ..... B65H 75/18; B65H 75/24

[52] U.S. Cl. ..... 242/597.5; 242/474.8; 242/486.8; 242/573.7

[58] Field of Search ..... 242/573.7, 573.9, 242/597.5, 486.8, 474.8, 570

[56] References Cited

U.S. PATENT DOCUMENTS

| | | | |
|---|---|---|---|
| 3,030,039 | 4/1962 | Roberts . | |
| 3,813,051 | 5/1974 | Miller . | |
| 3,917,182 | 11/1975 | Lenk . | |
| 3,923,261 | 12/1975 | Isoard et al. | 242/571.6 |
| 4,223,849 | 9/1980 | Schippers et al. . | |
| 4,429,838 | 2/1984 | Lenk et al. . | |
| 4,575,015 | 3/1986 | Sugioka et al. . | |
| 4,830,299 | 5/1989 | Mutter et al. . | |
| 4,852,819 | 8/1989 | Hasegawa et al. | 1/1 |
| 4,993,651 | 2/1991 | Ohno et al. | 242/570 |
| 5,007,595 | 4/1991 | Busenhart et al. | 242/573.7 |
| 5,603,463 | 2/1997 | Kumo et al. | 242/486.8 |
| 5,645,246 | 7/1997 | Sugioka et al. | 242/573.7 |
| 5,676,323 | 10/1997 | Wirz et al. . | |

FOREIGN PATENT DOCUMENTS

| | | |
|---|---|---|
| 0167708A1 | 1/1986 | European Pat. Off. . |
| 0078978B1 | 3/1986 | European Pat. Off. . |
| 0234844A2 | 9/1987 | European Pat. Off. . |
| 0217276B1 | 7/1992 | European Pat. Off. . |
| 0655409B1 | 8/1997 | European Pat. Off. . |
| 19607916 | 9/1996 | Germany . |

*Primary Examiner*—Michael R. Mansen
*Attorney, Agent, or Firm*—Dority & Manning

[57] ABSTRACT

A bobbin chuck for winding manmade threads can have a length of e.g. 1200 mm and can consist of a bearing portion and of a cantilevered portion supported by it. The cantilevered portion includes an extension (66) of a shaft (64) supported directly by the bearings and a tubular part (60) taking up the bobbin tubes which is connected at two locations (68, 70) to the shaft extension (66) and secured against rotation relative thereto. The shaft extension (66) as well as the tube (60) are free to perform oscillations according to their natural oscillation modes.

9 Claims, 3 Drawing Sheets

Fig.1
PRIOR ART
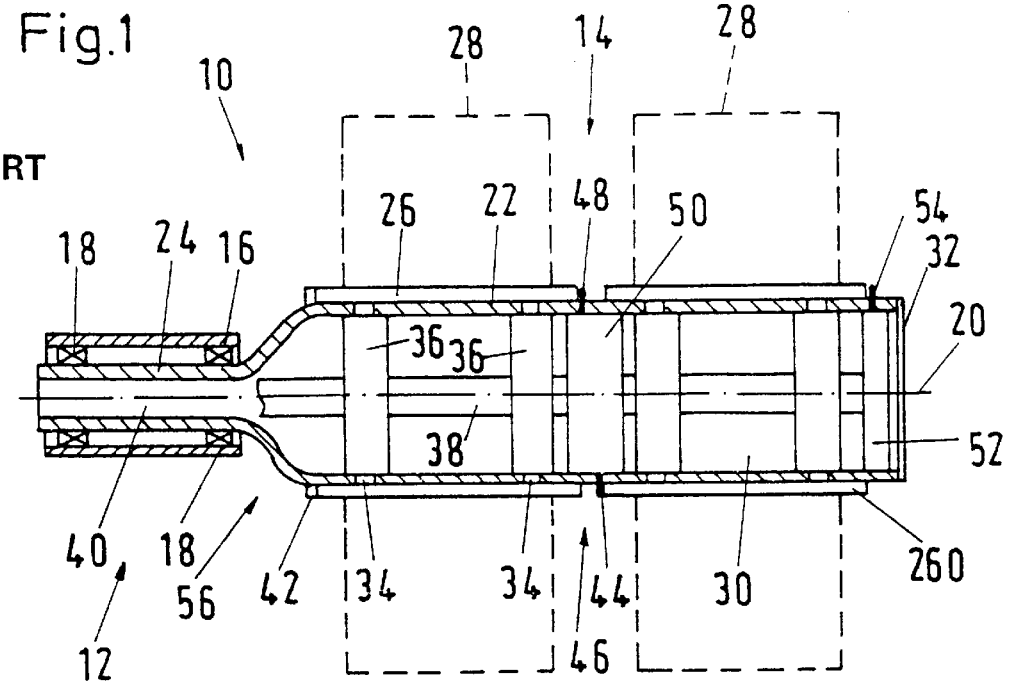
Fig.6
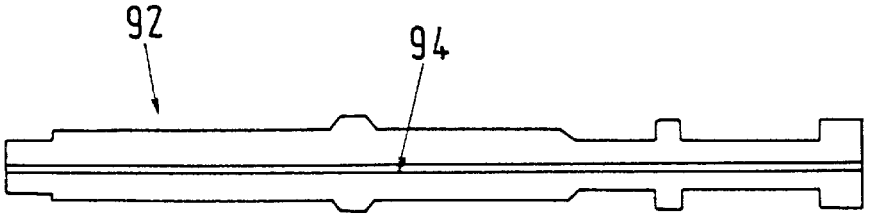
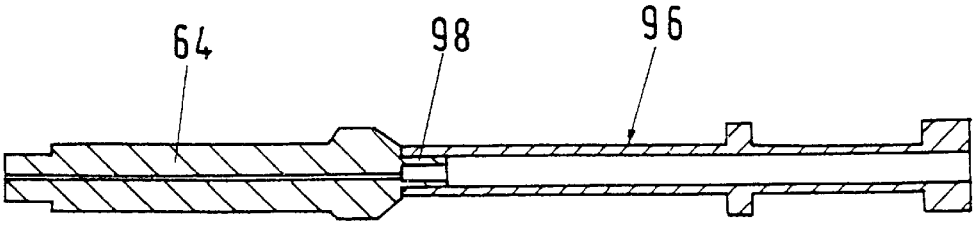
Fig.7

Fig.2
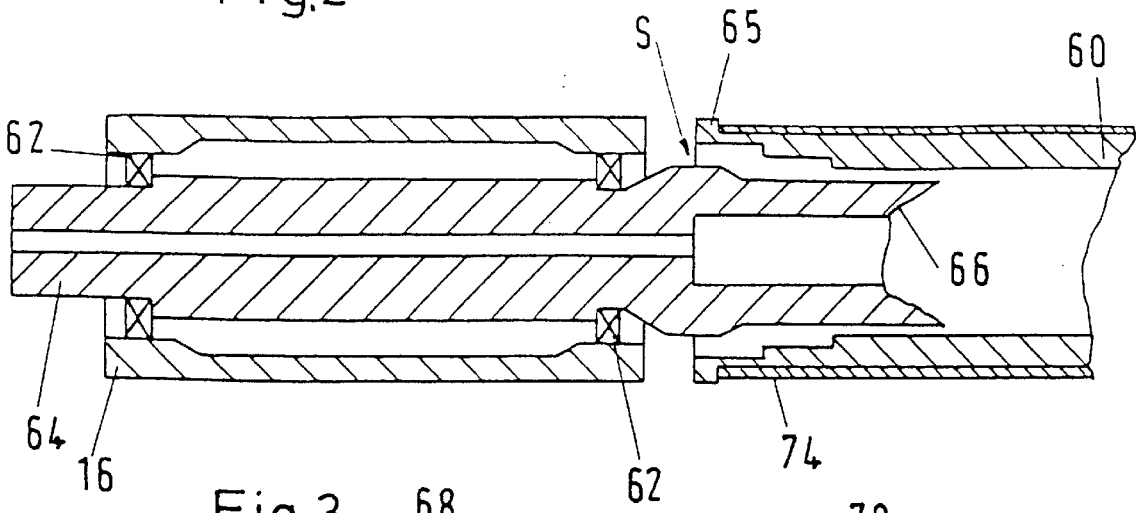
Fig.3
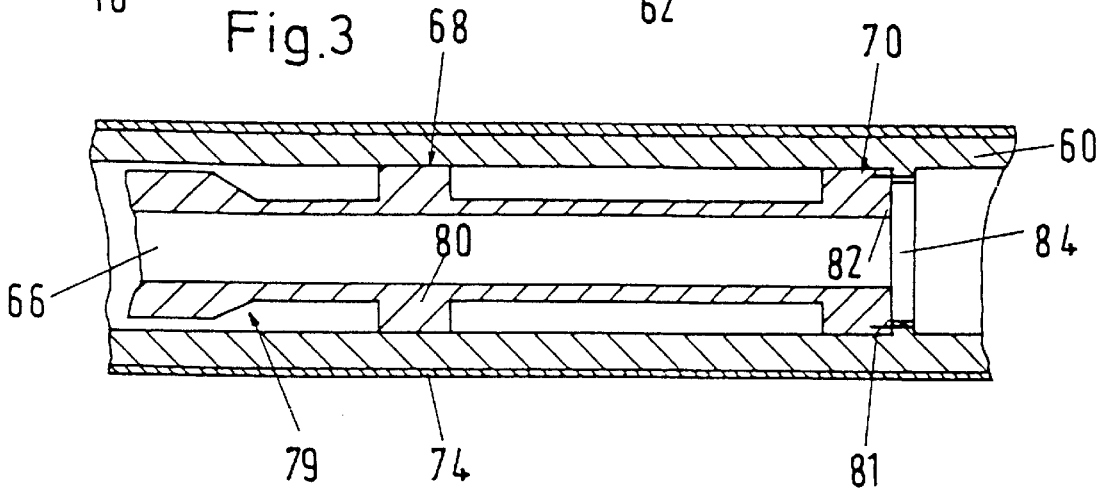
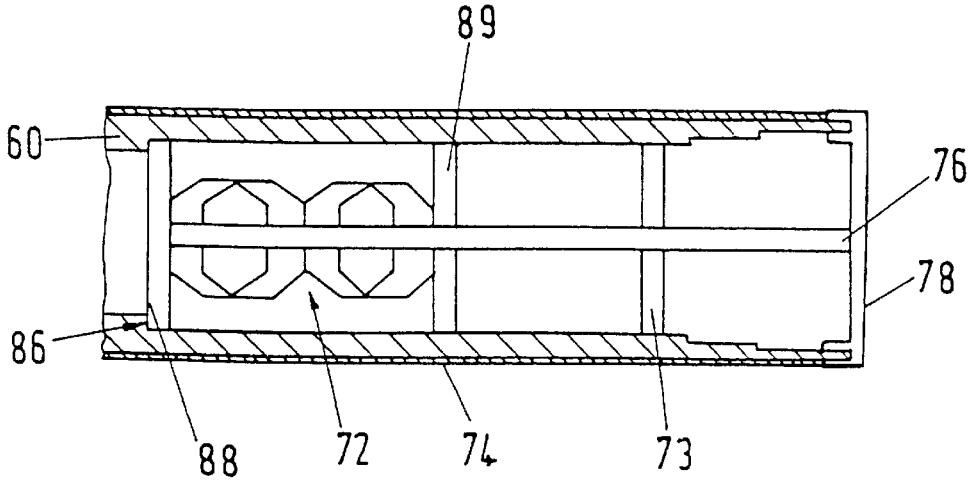
Fig.4

BOBBIN CHUCK

The invention concerns winding apparatuses for winding man made threads, in particular the design of a bobbin chuck provided on such winding machines. The new bobbin chuck according to the present invention is provided for application in an automatic winder which permits substantially waste-free bobbin change, but is not limited to this application.

BACKGROUND OF THE INVENTION

A bobbin chuck, or a spindle respectively, for winding man made threads normally is supported as a cantilevered structure in a support member (e.g. in a so-called revolver head). The (maximum permissible) rotational speed of the bobbin chuck is decisive for the (maximum attainable) winding speed, which winding speed as a rule is to be maintained as constant as possible during the winding process. Depending on the length of the bobbin chuck and on the maximum diameter of the thread package (or bobbin) to be produced, an applicable range of rotational speeds results for a given design of the bobbin chuck. This application range in practical use is limited by at least one critical (natural) rotational speed at which (due to vibrations) unstable behaviour of the bobbin chuck results, i.e. a behaviour impairing or endangering safe operation of the winding assembly.

Today it is common practice that the critical rotational speed limiting the range of applications is not the lowest ("first") critical rotational speed. It is the practice in the state of the art to operate at rotational speeds above the first critical rotational speed, the first critical speed range being traversed during the speed-up of the winder.

A first solution principle is discussed with reference to U.S. Pat. No. 3,813,051; U.S. Pat. No. 3,917,182; EP-A-167708 and EP-A-234844:

A design of a bobbin chuck, or of a spindle respectively, which is supposed to avoid vibrations is shown in U.S. Pat. No. 3,813,051. On a cantilevered shaft solidly connected to the machine frame, roller bearings are provided which in turn take up a cylindrical rotatable bobbin support element. Even if the patent document (column 2, lines 6 through 11) relates to the bobbin chuck drive as well as to the friction roll drive type, the arrangement shown evidently is conceived for the last-mentioned drive type.

U.S. Pat. No. 3,917,182 (DE-A-2261709) shows a bobbin chuck provided with a chuck drive arrangement laid out in such a manner that the "critical rotational speed" (column 3, lines 41 through 45) clearly lies below the range of operating speeds of the bobbin chuck (with or without a bobbin package). This bobbin chuck comprises a rotatable central shaft supported in roller bearings located in a cylindrical cantilevered structure fixedly mounted to the machine frame.

EP-A-167708 (U.S. Pat. No. 4,575,015) shows a further development concerning another problem (namely the supply of a pressurized medium through a longitudinal duct arranged in the central shaft of the bobbin chuck) in which the arrangement of the bearings as shown in DE-A-2261709 is maintained in principle. Finally EP-A-234844 describes a method of balancing a bobbin chuck according to EP-A-167708.

A second principle of a solution is discussed with reference to U.S. Pat. No. 3,030,039, DE-A-2356014 and EP-B-217276:

U.S. Pat. No. 3,030,039 concerns a design of a bobbin chuck laid out for simultaneously winding a plurality of threads, the vibration problems not being considered in particular. The chuck is conceived as a cantilevered rotatable element. The solution shown comprises a central shaft-type spindle supported rotatably in a support member, the spindle itself serving as a support for a member comprising a cylindrical part taking up bobbin tubes. The bobbin tube clamping system is to be mounted inside the latter part.

DE-A-2356014 deals with the problems of unbalance in such structures, in particular in connection with the bobbin tube clamping system. The explanations given are scanty, but they indicate that the bobbin chuck was composed of many parts which had to be "connected" (in any manner) with the central shaft.

According to EP-B-217276 a cylindrical part of the bobbin chuck supporting the bobbin tubes is formed by a part of the shaft directly supported by the bearings. All the smaller parts of the bobbin chuck are mounted within the cylindrical element in which they can be centered against, and be held back against, the centrifugal force by the inside wall of this element. The range of application of this chuck design, for chuck lengths in excess of 1000 mm, is limited to winding speeds of less than 4500 m/min, as otherwise the second critical rotational speed would fall into the range of applications.

SUMMARY OF THE INVENTION

Objects and advantages of the invention will be set forth in part in the following description, or may be obvious from the description, or may be learned through practice of the invention.

The present invention provides a bobbin chuck with a rotatable cantilevered element which comprises an inner longitudinal part and an outer part taking up bobbin tubes. The part taking up bobbin tubes is connected to the inner part and secured against relative rotation. The connecting means are arranged in such a manner that, at least at a critical rotational speed which would cause instability in the behaviour of the bobbin chuck, both elements are free to oscillate according to their natural mode. The longitudinal part and the part taking up bobbin tubes together are referred to as the "system" in the following.

The length of the chuck can be chosen longer than 1000 mm (e.g. 1200 or 1500 mm), the new design being applicable also to shorter bobbin chucks. Also, for longer bobbin chuck lengths the design can be laid out in such a manner that the lowest critical rotational speed of the system, which could result in unstable behaviour of the bobbin chuck (or of the system, respectively) is above the range of application. In the preferred arrangement, the lowest critical rotational speed of the system resulting in unstable conditions is the third critical rotational speed of the system which is determined by the second critical rotational speed of the part taking up the bobbin tubes. The range of application can be chosen between the second and the third critical rotational speeds of the system, the arrangement preferentially being laid out in such a manner that the second and the third critical rotational speeds of the system are distanced as far apart as possible.

The bobbin tube clamping system preferably is mounted on the outer surface of the part taking up the bobbin tubes but an operating device, however, can be arranged inside this part. The device activating the bobbin tube clamping system comprises, e.g., a clamping pack which is spaced from the outer end of the bobbin chuck, transmission means being provided for transmitting movements of the clamping pack all the way to the end of the bobbin chuck.

The arrangement can be laid out for taking up standard tubes, the inside diameter of the cylindrical inner surface of which ranges from 70 to 130 mm. Presently tubes of 73, 94, 110, or 125 mm inside diameter are in use, 125 mm inside diameter being considered as a rather unusual dimension.

The connection can be established by shrinking or adhesively connecting the part taking up bobbin tubes to connecting elements on the inner part. Two such elements can be provided which are preferentially each formed in one piece with the longitudinal part. But (also) a securing element, e.g. a screw, can be provided which secures the connection owing to interengagement.

The longitudinal part can be formed as a hollow shaft the wall thickness of which shaft may vary over the length of the shaft. The longitudinal part also can be designed as a solid shaft, or it can be provided with merely a longitudinal duct for a pressure fluid. The longitudinal part also can be composed of a plurality of elements.

Various design solutions according to the present invention are discussed in the following as examples with reference to the illustrations shown in the Figures.

BRIEF DESCRIPTION OF THE FIGURES

FIG. 1 is a copy of the FIG. 1 of EP-C-217276 as a basis for the explanation of the further development according to the present invention, FIG. 2 is a cross-sectional view of the "innermost" end portion (near the bearings) of a first bobbin chuck according to the present invention;

FIG. 3 is a cross-sectional view of the middle portion of the present bobbin chuck, FIG. 4 is a cross-sectional view of the outermost (free) end portion of the present bobbin chuck, FIG. 6 is a first alternative design solution according to the invention, and FIG. 7 is a second alternative design solution according to the invention.

DETAILED DESCRIPTION

Figure 2A:
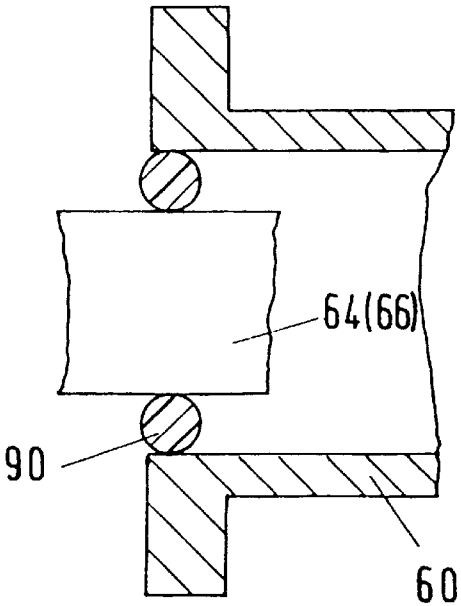
FIG. 2A shows a detail of FIG. 2 at a larger scale.

Reference will now be made in detail to one or more presently preferred embodiments of the invention, examples of which are illustrated and described herein. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the invention.

The bobbin chuck 10 shown in a schematic view in the FIG. 1 consists of a bearing portion 12 and of a cantilevered portion 14 supported by the portion 12. The bearing portion 12 comprises a housing 16 with bearing elements 18 which define a rotational axis 20. The bearing elements 18 take up a hollow shaft 24 which is connected to a cylindrical part 22 which takes up the bobbin tubes and with which it is formed in one piece. In the FIG. 1, only two bobbin tubes 26, 260 are shown, but the bobbin chuck 10 can be laid out also for simultaneous formation of more than two bobbin packages 28. The empty room 30 within the part 22 is closed at the free end of the bobbin chuck by a cover 32 and contains the bobbin tube clamping system. The latter system comprises piston-type operating devices 36 for bobbin tube clamping elements 34 which, through openings in the wall of the part 22, can be squeezed outwards against the corresponding bobbin tube. The devices 36 can be operated using compressed air via a tube 38 connected to a compressed air duct 40 provided in the shaft 24.

The inner tube 26 is positioned longitudinally along the bobbin chuck by a stop 42. For the (each) further tube (e.g. for the tube 260) positioning elements 44 are to be provided which can be moved from the inside room of the bobbin chuck to protrude and which can be retracted again into said room. Using such elements, a distance between neighbouring bobbin tubes 26, 260 can be maintained free in such a manner that thread catching elements 48 can be moved out from the inside room of the bobbin chuck between the bobbin tubes after the bobbin tubes have been positioned. Thread catching elements of the type mentioned are described in EP-C-217276. They are, however, not relevant within the context of the present invention and thus are no longer dealt with in this description. In the hollow room 30, also operating devices 50, 52 for the elements 44, 48 are provided which are not discussed further here, as the are not relevant for the further development.

The new bobbin chuck (FIGS. 2 through 4) according to the invention differs from the devices known thus far in that the part 60 taking up the bobbin tubes no longer is formed in one piece with the hollow shaft 64 (FIG. 2) directly supported by the bearings 62. The shaft 64 is provided with a hollow protruding longitudinal part (extension part) 66 which will be described in more detail in the following with reference to the FIGS. 3 and 4. The bearings 62 again are arranged in a housing 16 which, with the help of suitable support means (not shown), can be mounted onto the winder (e.g. in a machine according to WO 93/17948 or EP 655409).

The part 60 taking up the bobbin tubes comprises a substantially tubular body ("tube") the outside diameter of which is kept as constant as possible and the ends of which are open. The tube 60 is connected at two locations 68 and 70, respectively, in its middle portion (FIG. 3) to the extension part 66, both end portions of the tube 60 remaining free in such a manner that they can perform oscillations with respect to other portions of the bobbin chuck as will be explained in the following. At its "inner" end (in the vicinity of the shaft 64) the tube 60 is provided with a bobbin tube stop 65 which, however, also serves as a balancing ring, as will be explained further in the following.

The extension part 66 does not extend into the front portion (FIG. 4) of the tube 60 but this portion contains a (clamping) spring pack 72 which (e.g.) can be designed according to EP-B270826 and which serves for operating a bobbin tube clamping system 74. The latter system 74 is arranged on the cylindrical outer surface of the tube 60. The illustrations shown in the FIGS. 2 through 4 being merely schematic it should be noticed that bobbin tube clamping systems of this type are known from e.g. the machine J7/A2 produced by Maschinenfabrik Rieter AG or, respectively, from DE-A-19607916; EP-A-234844; DE-A-3039064; EPA-078978 or from U.S. Pat. No. 4,223,849. A rod 76 transmits the clamping forces, or the clamping movement respectively, of the clamping pack 72 to a cover element 78 which in this case not only acts as an end closure element, but also as an element transmitting the clamping forces to the system 74. The element 78 can be used also for balancing, in which arrangement this function possibly can be taken over by a disk-shaped element 73 within the bobbin chuck. This latter element in any case serves as a guide element for the rod 76.

The wall thickness of the hollow extension part 66 is chosen relatively large in the zone adjacent to the shaft 64 in which arrangement this wall thickness diminishes in longitudinal direction of the part 66 away from the shaft, either continually or, as shown, at a step shoulder portion 79. The extension part 66 furthermore is provided with two ring elements 80, and 82 respectively, protruding radially outward and defining the above mentioned connecting locations 68, 70 in which arrangement one of the rings, ring 82, is formed on the outermost end (distant from the shaft 64) of the extension part 66. Each ring element 80, 82 offers a connecting surface to the inside surface of the tube which can be of cylindrical or of conical shape. The actual connection may be effected, e.g., by friction, e.g. in such a manner that the tube 60 is mounted onto the elements 80, 82 by shrinking or that the two elements by means of a suitable device (not shown) are pressed against each other and thus are squeezed radially outward. In an alternative arrangement, an adhesive is provided or inserted between the surfaces of the elements 80, 82 and the inside surface of the tube 60 which results in a connection preventing rotation of the elements relative to each other. If required, a securing element 81 (e.g. in the form of a screw or a pin) can be provided in order to prevent any relative rotation between the shaft and the tube.

The wall thickness of the tube 60 is kept as constant as possible over the largest possible portion of its length, in which arrangement in both end zones a stepped reduction of the wall thickness towards each tube end is provided as will be explained also in the following. Furthermore, at a predetermined location an inner ring 84 (FIG. 3) is provided which serves as a stop for the end ring 82 of the longitudinal part. In the vicinity of this inner ring 84, a shoulder 86 (FIG. 4) is pro vided which serves as an end stop for a piston 88 rigidly connected to the rod 76, the inside surface of the tube 60 forming a "cylinder" for this piston. The clamping pack 72 is compressed between the piston 88 and a disk-shaped stop 89.

The function of the elements shown now are to be explained in more detail with reference to the schematic illustration shown in the FIG. 5.

In each of the FIGS. 5A through 5D the bearings 62, the shaft 64, including the extension element 66 and the tube 60, are shown in a schematic view. In the illustration according to the FIG. 5A, these elements together form, in terms of balancing technology, a "rigid rotor", e.g. at rotational speeds near zero.

Figure 5A:
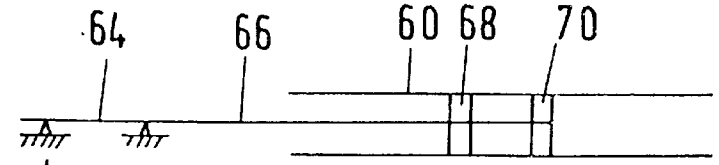
FIGS. 5A through 5D are a diagrammatic view of "oscillation patterns" of the bobbin chuck according to the Figs. 2 through 4.
Figure 5B:
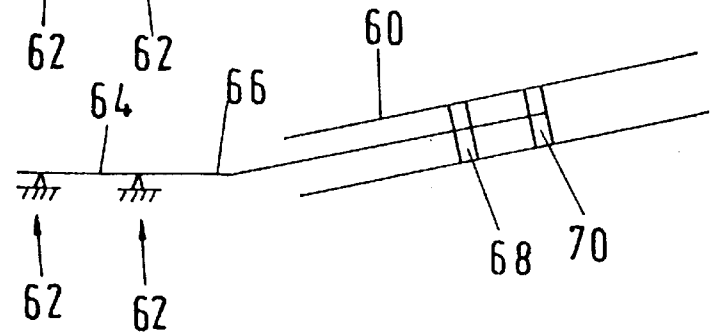
Figure 5C:
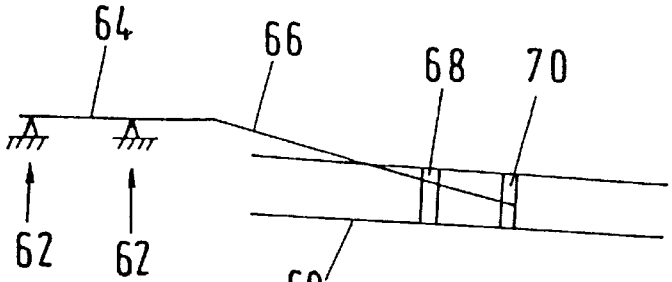

At a relatively low rotational speed (e.g. about 600 rpm) the bobbin chuck behaves according to the pattern indicated in the FIG. 5B, i.e. the extension part 66 in the direction away from the location of the bearing increasingly bends, the tube 60 still behaving like a "rigid" body. The pattern indicated in the FIG. 5B represents a first "natural mode" of the oscillation behaviour of the extension part 66. The rotational speed at which this state is induced, can be called the "first critical" rotational speed of the extension part 66. This rotational speed also can be called the first "critical rotational speed of the system". This rotational speed is so low that it is clearly below the range of applications and that it just is to be traversed during the speed-up of the winder, which can be effected without risks.

At a higher rotational speed, e.g. at about 6800 rpm, the tube 60 also starts bending elastically with respect to the locations of the connections 68, 70, the tube remaining approximately straight in this case. This represents the first "natural mode" of the oscillation behaviour of the tube 60 and an oscillation pattern according to the FIG. 5C results. The rotational speed at which this pattern is induced can be called the "first critical" rotational speed of the tube 60 and/or the "second critical rotational speed of the system". This rotational speed falls within the range of operating speeds of the winder and presents a problem, the behaviour being "benign", however (within tolerable limits). The problem in many cases can be successfully warded off if one (or a plurality) of the following measures are taken:

1) balancing (e.g. at the ring 65, FIG. 2, mentioned above, or at the cover element 78, FIG. 4 respectively),
2) suitable stepping of the decrease of the wall thickness in the end zones of the tube 60,
3) application of vibration dampening materials at suitable points.

Figure 5D:
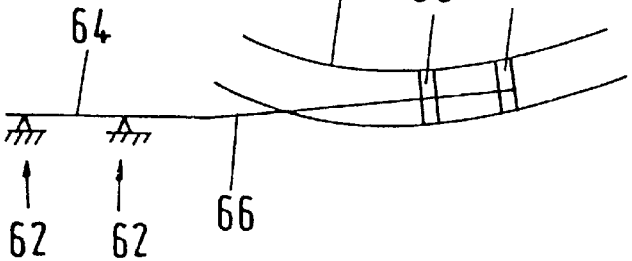

At a still higher rotational speed, finally, e.g. in the neighbourhood of 23500 rpm, also the tube 60 starts bending elastically in its own longitudinal direction which results in an oscillation pattern according to the FIG. 5D. The two connecting elements 68, 78 (FIG. 3) are arranged as closely as possible near the "node" of this bending curve, which signifies that the clamping pack 72 (FIG. 4), with its corresponding additional weight, also is arranged near the node. The rotational speed which induces this second natural shape of the tube can be called the "second critical" rotational speed of the tube 60 and/or the "third critical rotational speed of the system".

The effects of these oscillations to a certain extent can be alleviated by dynamically balancing the tube; the behaviour of the oscillation problem in this case, however, is not benign but malign. Once this natural oscillation shape has been established, further increases in rotational speed sooner or later result in unstable conditions, in a "breakdown accident". The process of dynamic balancing is effected, if possible, in at least three planes, e.g. at both ends of the tube 60 and at a suitable point in-between them. The upper limit of the range of feasible rotational speeds of the bobbin chuck is determined by the quality of the balancing method. The extension part 66 can be designed in such a manner that its second critical rotational speed is markedly higher than the second critical rotational speed of the tube 60, and the second natural oscillation mode of the extension part is of no consequence in determining the range of applications of the bobbin chuck.

In the FIG. 2A an advantageous design is shown of the "transition zone" in which the shaft 64 merges into the extension part 66. According to the FIG. 2, an annular gap S (FIG. 2) exists between the shaft 64, or the extension part 66 respectively, and the tube 60. The gap S should be chosen big enough in such a manner that the oscillations of the tube 60 do not result in contacts with the inner elements. For safety reasons an elastic element 90 (FIG. 2A), e.g. an O-Ring, may be provided in the gap S in order to preclude the contacts mentioned.

In certain cases, it might not be possible to keep the oscillation problem at the second critical rotational speed of the system under control by taking the measures mentioned above. In such cases, a "calming" effect on the oscillations of the tube 60 can be obtained at its first critical rotational speed in such a manner that these oscillations partially are transmitted to the shaft 64, preferentially via energy-absorbing or vibration-absorbing means. These means represent a "coupling" which should loose its coupling effect at higher rotational speeds, as the tube 60 at its second critical rotational speed should be free to perform its oscillations according to its natural oscillation mode. A type of "centrifugal coupling" can fulfil this function. A suitable solution can be explained with reference to the FIG. 2A. The coupling consists of at least one O-Ring made of rubber or a similar material which, while being mounted between the shaft 64 and the tube 60, shows a predetermined cross-section which e.g. fills the gap S between the shaft 64 and the tube 60. The material of the O-ring is chosen such that at rotational speeds of the bobbin chuck of up to the second critical rotational speed of the system, its predetermined cross-section is maintained substantially constant. Oscillations of the tube 60 at the second critical rotational speed of the system thus alternately cause compression, and expansion respectively, of the O-ring. The material of the O-ring absorbs part of the energy of the oscillations, which energy thus is not transmitted as kinetic energy to the shaft 64—the absorbed energy being given off by the dampening element 90 in the form of heat. A further part of the kinetic energy is transmitted via the O-ring to the shaft 64 and is "annihilated" in the material of the shaft.

The O-ring functions as a coupling as long as sufficient contact prevails between the O-ring 90 and the shaft 64. The O-ring material, however, is chosen so soft that under the influence of the centrifugal force it extends radially, i.e. that its inner surface recedes from the shaft 64, its cross-section being deformed. An oscillation-transmitting contact on the shaft 64 thus is possible only up to a predetermined rotational speed and is lost as soon as the O-ring at higher rotational speeds is pressed outward against the inner surface of the tube 60. Stiffness of the O-ring can be chosen in such a manner that the loss of the coupling (or transmitting) effect occurs in a predetermined range of rotational speeds between the second and the third critical rotational speed of the system.

In the FIGS. 6 and 7, an alternative design example each is shown of the shaft 64 according to the FIGS. 2 through 4. The shaft 92 according to the FIG. 6 is designed substantially as a solid shaft (rather than a hollow shaft such as the shaft 64) a longitudinal duct 94 extending along its longitudinal axis. Via this duct 94 a pressure fluid is supplied to the clamping pack 72 which is unchanged with respect to the FIG. 4. In the FIG. 7, again an alternative design example is shown with a hollow shaft 96 which as a separate element is pushed onto a "plinth" 98 in which arrangement the stiffness of the shaft in the vicinity of the bearing portion is noticeably increased.

It will be apparent to those skilled in the art that various modifications and variations can be made in the present invention without departing from the scope or spirit of the invention. It is intended that the present invention include such modifications and variations as come within the scope of the appended claims and their equivalents.

I claim:

1. A bobbin chuck for winding threads thereon at operational rotational speeds of said bobbin chuck, comprising:

a cantilevered rotatable element, said rotatable element comprising an outer longitudinal tubular member configured for taking up bobbin tubes on an outer surface thereof, and an inner longitudinal shaft member extending at least partially within said outer longitudinal member and connected thereto;

a connection mechanism between said inner and outer longitudinal members between ends of said outer longitudinal member that non-rotationally connects said inner and outer longitudinal members;

said connected inner and outer longitudinal members having natural oscillation modes at given first and second critical rotational speeds, wherein said first critical rotational speed is a speed below said operational rotational speeds of said bobbin chuck and said second critical rotational speed is within operational rotational speeds of said bobbin chuck;

wherein said connection mechanism is configured so that at about said second critical rotational speed, said inner and outer longitudinal members are free to oscillate at their said respective natural oscillation modes; and an oscillation transmitting device operationally disposed between said inner and outer longitudinal members, said oscillation transmitting device comprising a coupling device that couples said inner and outer longitudinal members up to about said second critical rotational speed of said system and decouples from said inner and outer longitudinal members at speeds greater than about said second critical rotational speed of said connected inner and outer longitudinal members.

2. The bobbin chuck as in claim 1, wherein said coupling device comprises a resilient ring member disposed between said inner and outer longitudinal members, said ring member changing its cross-sectional shape at speeds greater than about said second critical rotational speed of said system to minimize transmission of oscillations between said inner and outer longitudinal members.

3. The bobbin chuck as in claim 1, further comprising a bobbin tube clamping system mounted at least in part within said outer longitudinal member.

4. The bobbin chuck as in claim 3, wherein said clamping system comprises a spring pack disposed within said outer longitudinal member between said ends thereof, and a transmitting device configured so as to transmit movement of said spring pack to at least an outer end of said bobbin chuck.

5. The bobbin chuck as in claim 4, wherein said spring pack is disposed within said outer longitudinal member.

6. The bobbin chuck as in claim 5, wherein said connection mechanism comprises spaced apart radially extending members of said inner longitudinal member that contact against an inner surface of said outer longitudinal member.

7. The bobbin chuck as in claim 1, wherein said connection mechanism comprises a friction fit between spaced apart connecting elements disposed between said inner and outer longitudinal members.

8. The bobbin chuck as in claim 7, wherein said spaced apart connecting elements comprise radially extending members of said inner longitudinal member.

9. The bobbin chuck as in claim 1, wherein said connection mechanism comprises an adhesive connection between spaced apart connecting elements disposed between said inner and outer longitudinal members.

* * * * *